US008132424B2

(12) United States Patent
Burn

(10) Patent No.: US 8,132,424 B2
(45) Date of Patent: Mar. 13, 2012

(54) ICE MACHINES WITH EXTRUDED HEAT EXCHANGER

(75) Inventor: Mark Burn, Port Townsend, WA (US)

(73) Assignee: Integrated Marine Systems, Inc., Port Townsend, WA (US)

( * ) Notice: Subject to any disclaimer, the term of this patent is extended or adjusted under 35 U.S.C. 154(b) by 566 days.

(21) Appl. No.: 12/284,091

(22) Filed: Sep. 17, 2008

(65) Prior Publication Data

US 2010/0064717 A1 Mar. 18, 2010

(51) Int. Cl.
*A23G 9/00* (2006.01)

(52) U.S. Cl. ..... 62/345; 62/346; 62/353; 165/171; 165/174

(58) Field of Classification Search ..... 62/353, 62/513, 71, 340, 342, 347, 394; 165/133, 165/140, 168, 513, 515
See application file for complete search history.

(56) References Cited

U.S. PATENT DOCUMENTS

| | | | | |
|---|---|---|---|---|
| 490,475 A | | 1/1893 | Holden | |
| 2,860,490 A | * | 11/1958 | Taylor | 62/71 |
| 3,069,868 A | | 6/1961 | Lees | 62/347 |
| 3,145,017 A | | 8/1964 | Thomas | 259/45 |
| 3,255,815 A | | 6/1966 | Smith | 165/94 |
| 3,328,972 A | | 7/1967 | Svanoe | 62/123 |
| 3,534,563 A | | 10/1970 | Ross | 62/222 |
| 3,786,653 A | | 1/1974 | Blomberg | 62/491 |
| 4,159,740 A | | 7/1979 | Seiling | 165/147 |
| 4,250,718 A | | 2/1981 | Brantley | 62/354 |
| 4,656,836 A | | 4/1987 | Gilbertson | 62/185 |
| 4,682,475 A | | 7/1987 | Nelson | 62/354 |
| 4,739,630 A | | 4/1988 | Tandeski et al. | 62/354 |
| 4,796,441 A | | 1/1989 | Goldstein | 62/354 |
| 5,042,574 A | | 8/1991 | Cottone et al. | 165/133 |
| 5,099,913 A | | 3/1992 | Kadle | 135/147 |
| 5,157,939 A | | 10/1992 | Lyon et al. | 62/345 |
| 5,242,015 A | | 9/1993 | Saperstein et al. | 165/163 |
| 5,312,184 A | | 5/1994 | Cocchi | 366/302 |

(Continued)

FOREIGN PATENT DOCUMENTS

EP 641 980 3/1995

(Continued)

OTHER PUBLICATIONS

Search Report and Written Opinion mailed Oct. 5, 2009 in PCT/US09/04651, filed Aug. 13, 2009.

*Primary Examiner* — Frantz Jules
*Assistant Examiner* — Emmanuel Duke
(74) *Attorney, Agent, or Firm* — McDonnell Boehnen Hulbert & Berghoff LLP

(57) ABSTRACT

A heat exchanger for an ice machine has the form of a cylinder. In some embodiments, the cylinder is made from an extrusion of a metal such as an aluminum alloy. The heat exchanger includes inner and outer cylindrical walls and one or more refrigeration passages positioned between the inner and outer walls. The inner and outer walls are separated from each other by connecting structures defining the refrigeration passages. The heat exchanger can be extruded as a rectangular panel and subsequently formed into a cylindrical form. Alternatively, the heat exchanger can be extruded as a cylinder, or as an arcuate cylindrical segment in which several of such segments are subsequently joined together (as by welding) into a cylinder. Ice machines that feature ice formation on both the inner and outer walls of the cylinder are also disclosed.

8 Claims, 11 Drawing Sheets

U.S. PATENT DOCUMENTS

| | | | | | |
|---|---|---|---|---|---|
| 5,431,027 | A | | 7/1995 | Carpenter | 62/354 |
| 5,488,836 | A | | 2/1996 | Laude-Bousquet | 62/532 |
| 5,522,236 | A | | 6/1996 | Jensen et al. | 62/354 |
| 5,575,066 | A | * | 11/1996 | Cocchi | 29/890.035 |
| 5,632,159 | A | | 5/1997 | Gall et al. | 62/354 |
| 5,884,501 | A | | 3/1999 | Goldstein | 62/342 |
| 5,918,477 | A | | 7/1999 | Gall et al. | 62/354 |
| 6,056,046 | A | | 5/2000 | Goldstein | 165/147 |
| 6,253,573 | B1 | * | 7/2001 | Schwitters et al. | 62/513 |
| 6,286,332 | B1 | * | 9/2001 | Goldstein | 62/342 |
| 6,477,846 | B2 | | 11/2002 | Yundt, Jr. | 62/71 |
| 2004/0194940 | A1 | * | 10/2004 | Manasek et al. | 165/168 |
| 2008/0185130 | A1 | * | 8/2008 | Fang | 165/140 |

FOREIGN PATENT DOCUMENTS

| | | |
|---|---|---|
| GB | 2 232 469 | 12/1990 |

* cited by examiner

FROM REFRIGERANT SOURCE
TO CONDENSER
FROM WATER SOURCE
10
12
14
16
18
20
30
32
34
36
38
40
42
44
46
47
50
52
54
56
58

ICE MACHINES WITH EXTRUDED HEAT EXCHANGER

BACKGROUND OF THE INVENTION

A. Field of the Invention

This invention relates generally to the field of ice machines making flake or slurry ice and heat exchangers used in such machines. The invention also relates to a method of manufacturing a heat exchanger for an ice machine.

B. Description of Related Art

Ice is commonly manufactured by even rotational distribution of water around the inside of a vertically-arranged refrigerated cylinder. Another common method is by an even application of water on the outside of a rotating refrigerated drum. The water freezes on the refrigerated surface forming an ice film. The ice film thickness and ice production rate are determined by the water application rate, rotation speed, and the rate at which the refrigerated surface absorbs the heat from the water as ice is formed. A reamer, scraper or like device cracks or otherwise removes the ice from the refrigerated surface, clearing the drum (or cylinder) ahead of the water application, thus continually forming and removing ice (typically in the form of flakes or chunks) as the drum or water application and reamer arm rotates.

Slurry (soft ice) is commonly formed inside a refrigerated heat exchanger cylinder filled with water where a dasher or other device removes ice crystals and/or sub-cooled water from the refrigerated surface before an ice film develops.

The drum (or cylinder) of the above types of ice machines is a heat exchanger and includes an internal passage or internal passages for circulation of a refrigerant. Heat is transferred from the water through the walls of the drum or cylinder to the refrigerant.

The prior art in the art of ice machines includes the following U.S. patents: Goldstein, U.S. Pat. Nos. 6,056,046, 6,286,332; 5,884,501 and 4,796,441; Lyon, U.S. Pat. No. 5,157,939; Gall et al., U.S. Pat. Nos. 5,918,477 and 5,632,159; Tandeski et al., U.S. Pat. No. 4,739,630; Jensen et al., U.S. Pat. No. 5,522,236; and Yundt et al., Jr., U.S. Pat. No. 6,477,846.

In machines designed for producing ice, the refrigerated drum or cylinder is commonly the most expensive part of the machine to manufacture. Additionally, the drum or cylinder is often classed as a pressure vessel and subject to strict manufacturing standards embodied in manufacturing codes, and regulatory oversight and inspections. These regulations and manufacturing standards are in place to provide protection from the hazards of pressure vessels exploding under the internal pressure of the refrigerant. Pressure vessel wall thickness must be adequate to withstand the pressures they are subject to and to meet the safety factors stipulated by pressure vessel manufacturing standards. Increased wall thickness between the refrigerant contained inside the vessel and the water freezing on the external surface of the drum or cylinder increases material cost and impedes heat transfer, reducing the efficiency of the ice production.

In many applications, a relatively non-corrosive material such as stainless steel is required for the ice forming surface. In larger ice machines, this surface may be ¾" thick, or even thicker, to provide the necessary strength, greatly increasing cost and reducing heat transfer. To compensate for this reduced heat transfer, a lower refrigerant temperature is required for a given ice production rate, which in turn requires larger, more expensive refrigeration machinery and more energy input per unit of ice production.

Another method of manufacturing refrigerated drums or cylinders for ice production not subject to pressure vessel construction codes include machining refrigerant passages in a thick walled cylinder, then skinning it with an interference fitting secondary cylinder, thus creating refrigerant passages. Another method is by lining the inside or outside of the ice producing surface with tubing or fabricated passages creating refrigerant channels where cold refrigerant cools the ice-producing surface. These methods are labor intensive, involve relatively high material costs, and suffer from relatively low heat transfer rate and energy efficiencies.

This disclosure overcomes the deficiencies of the prior art by providing an ice machine, heat exchanger for an ice machine, and methods of manufacturing the heat exchanger which provides for high heat transfer efficiency, reduced labor and materials costs in construction, and does not require that the drum or cylinder in the machine meet pressure vessel construction codes. The ice machine and manufacturing methods of this disclosure reduce ice machine size and manufacturing costs, as well as reduce accompanying refrigeration system size, cost, and operating costs for the machine.

A further aspect of this disclosure also describes methods and ice machines which increase the efficiency and ice production rate for a given drum size by utilizing both the inside and outside surface of the ice-forming cylinder or drum for ice production. The disclosed utilization of both the inside and outside surface can be applied to conventionally constructed drums (e.g., those manufactured as a pressure vessel), as well as the improved heat exchanger drums of this disclosure.

SUMMARY OF THE INVENTION

In a first aspect, an ice machine is provided which includes a heat exchanger having a cylindrical configuration. The heat exchanger is made from an extrusion of a metal, preferably an aluminum alloy. The heat exchanger includes inner and outer cylindrical walls and refrigeration passages positioned between the inner and outer walls. The inner and outer walls are separated from each other by wall-like connecting structures which define the refrigeration passages. The refrigeration passages optionally include a multitude of raised and recessed features formed typically in either the inner wall or the outer wall (or both) depending on the configuration of the heat exchanger, increasing the surface area of the refrigeration passages thereby enhancing the heat transfer characteristics of the heat exchanger. The ice machine further includes a source of refrigerant and circuitry delivering the refrigerant to the refrigeration passages in the heat exchanger, one or more devices providing water to one or both of the walls of the heat exchanger, and a device such as scraper, dasher, or reamer for removing ice formed on one or both walls of the heat exchanger.

In one possible configuration, the heat exchanger takes the form of a plurality of individual cylindrical heat exchanger segments having the inner and outer walls, raised and recessed features and refrigeration passages as recited above, abutted against each other in a longitudinal arrangement. In another possible configuration, the heat exchanger extrusions are extruded as arcuate segments. The extrusion itself can be of any arbitrary length. The arcuate segments are preferably designed such that an integer number of them can be combined to make a full cylinder. For example, the arcuate segments can extend for 90 degrees of an arc, in which four segments can be combined to form a complete cylinder. As another example, each arcuate segment extends for 60 degrees of an arc, and six of such segments can be combined to form a complete cylinder. The arcuate segments are joined with each other, e.g., by welding the edges of each segment to the adjacent segment so as to form a cylindrical configuration. In still another configuration, the heat exchanger extrusions are extruded in planar form which are subsequently bent or formed into arcuate segments, and several of such segments joined e.g., by welding to each other to form a cylinder.

In another possible configuration, the heat exchanger further includes a metal (e.g., stainless steel) shell applied to the exterior wall of the heat exchanger, and wherein the water application device applies the water to the stainless steel shell.

In another possible configuration, a metal shell is applied to the interior wall of the heat exchanger, and the water application device applies the water to the stainless steel shell.

In another possible configuration, a metal shell is applied to both the interior and exterior walls of the heat exchange. A water application device applies the water to both the metal shells. A reamer, scraper or other similar ice-removing device circulates about both of the metal shells to remove ice formed on both shells.

The refrigeration passages can be arranged in several different configurations. In one configuration, the refrigerant passages include an inlet for liquid refrigerant and an outlet for refrigerant liquid and/or gas, and the refrigerant passages are constructed such that the refrigerant makes only a one circumferential pass around the heat exchanger in circulation between the inlet and the outlet. Alternatively, the refrigerant passages and the inlet and outlet can be constructed such that the refrigerant makes less than one circumferential pass around the refrigerant passages between the inlet and the outlet.

In another configuration, the refrigerant passages are constructed such that the refrigerant makes more than one circumferential pass around the heat exchanger in circulation between the inlet and the outlet, such as for example 3, 5 or 10 circumferential passes around the cylinder.

In still another configuration, the refrigerant passages are formed such that they are arranged in a longitudinal orientation wherein the refrigerant circulates back and forth in a direction parallel to the main axis of the heat exchanger cylinder or drum. The passages could be constructed such that the inlets are at one end of the drum and the outlets are at the other end and the refrigerant circulates in one pass from one end to the other. Alternatively, the refrigerant could circulate along the length of the drum multiple times back and forth between one end and the other as many times as desired.

In still another possible configuration, the heat exchanger is formed as a rectangular panel which is subsequently formed into a cylinder. The panel includes a first edge and an opposite second edge. An end cap is affixed to the first and second edges. The end cap extends transversely along the length of the heat exchanger and joins the first and second edges together. The cap operates to direct the flow of refrigerant through the passages. For example, the cap can serve to connect one refrigerant passage to another such that the refrigerant flows around the cylinder in multiple circumferential passes between the inlet and the outlet. Multiple cylinders can be butted together along the central axis of the cylinder in the longitudinal direction to make a heat exchanger of the desired length.

In another possible configuration, the heat exchanger is formed as a cylindrical extrusion of any suitable length. The extrusions can be cut to any desired length to form a cylindrical drum of the desired length for the heat exchanger.

In another aspect of this disclosure, a heat exchanger for an ice machine is provided, comprising a cylindrical body formed as an extrusion of a metal such as an aluminum alloy. The heat exchanger includes inner and outer cylindrical walls and refrigeration passages positioned between the inner and outer walls, and the inner and outer walls separated from each other by connecting structures defining the refrigeration passages.

Optionally, a multitude of raised and recessed features are formed in the refrigeration passages increasing the surface area of the refrigeration passages thereby enhancing the heat transfer characteristics of the heat exchanger.

In still another aspect, a method is disclosed for manufacturing a heat exchanger for an ice machine. The method includes the steps of obtaining one or more extruded metal panels having first and second opposites walls, first and second edges, and refrigeration passages positioned between first and second walls, the first and second walls separated from each other by connecting structures defining the refrigeration passages; and forming the one or more extruded panels into a cylinder such that the first and second edges are joined together, with the first wall forming the outer wall of the cylinder and the second wall forming the inner wall of the cylinder.

In one configuration, the method may further include a step of fitting an end cap to the first and second edges. The end cap provides a structure to control the distribution of the refrigerant circulated through the refrigerant passages.

In another aspect, the method may further include the step of manufacturing two or more of the heat exchangers having the cylindrical configuration as recited above, and abutting the two or more heat exchangers together in a longitudinal arrangement to thereby form a unitary heat exchanger.

In another aspect, a method of manufacturing a heat exchanger for an ice machine is disclosed, comprising the steps of: obtaining a plurality of extrusions of an aluminum alloy in the form of arcuate segments, each of the arcuate segment having first and second opposite walls, first and second edges and refrigeration passages positioned between first and second walls, the first and second walls separated from each other by connecting structures defining the refrigeration passages, and joining the segments to each other to form a cylindrical heat exchanger.

In still another aspect, a method of manufacturing a heat exchanger for an ice machine is disclosed, comprising the steps of: obtaining a cylindrical extrusion of an aluminum alloy having first and second opposites walls and refrigeration passages positioned between first and second walls, the first and second walls separated from each other by connecting structures defining the refrigeration passages, and cutting the extrusion to a desired length to form the heat exchanger.

Further embodiments are disclosed in which ice is formed on both the inner and outer walls of the heat exchanger simultaneously. In a flake ice embodiment, a water application device and sprayer are provided for both the inner wall the cylindrical heat exchanger and the outer wall of the heat exchanger. In a slurry ice embodiment, the heat exchanger is positioned in a vessel and water is supplied to the vessel such that the exterior surface of the heat exchanger is substantially immersed in water. Water is also supplied to the interior region of the cylindrical heat exchanger defined by the inner cylindrical wall and fills the interior of the heat exchanger. Dashers or other ice removal devices rotate rapidly around both the exterior and interior surfaces of the heat exchanger walls to remove ice or super-cooled water from both the inner and outer surfaces of the heat exchanger. Ice crystals form on the surface of the heat exchanger walls or in the water within the heat exchanger drum. Ice is suspended within the water and is carried off as a slurry. Water is introduced into the interior of the heat exchanger and into the vessel at the same rate that the slurry is carried off to enable continuous production of slurry ice. In these "double duty" ice machines (both flake and slurry), the refrigerant passages in the heat exchanger typically are typically arranged to extend from one end of the ice machine to the other, which is enabled by the arcuate or cylindrical extrusions described below.

The "double duty" ice machine, where ice is formed on both the inner and outer walls of the heat exchanger can be utilized with conventional heat exchanger drums, as wells as the improved, extruded drums or cylinders of this disclosure.

BRIEF DESCRIPTION OF THE DRAWINGS

In FIG. 2, the water application device and the scraper are configured in the interior of the heat exchanger and the circuitry supplying refrigerant passages in the heat exchanger is positioned on the exterior of the heat exchanger.

FIG. 5 also shows optional surface features in the refrigerant passages that increase the heat transfer efficiency of the heat exchanger. The surface features can be formed on the inside wall of the refrigerant passage as shown or on the outside wall of the passage, on both the inside and outside walls of the passage, or on all the interior surfaces of the passages.

FIG. 10B also shows diverters welded to the ends of the connecting structures which allow for circulation of the refrigerant through many passes around the periphery of the heat exchanger between the entrance ("in") for the refrigerant and the exit ("out") for the refrigerant.

DETAILED DESCRIPTION

Figure 1:
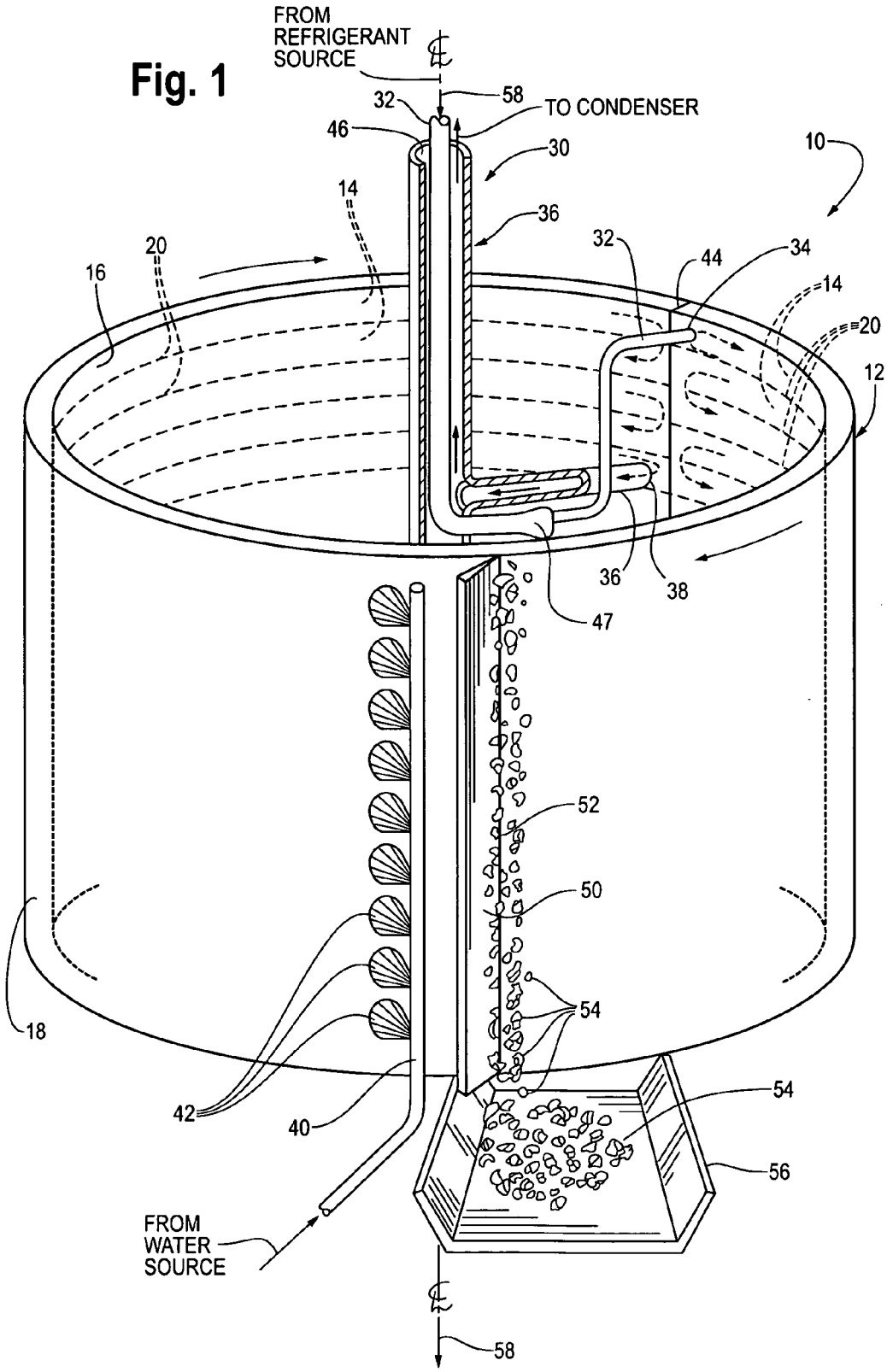
FIG. 1 is perspective view of an ice machine according to one possible embodiment. The heat exchanger is shown schematically in order to show the refrigeration passages within the walls of the heat exchanger. The ice machine includes a device adapted to provide liquid water to the surface of the heat exchanger and a scraper, reamer or other device to remove ice which is formed on the surface of the heat exchanger. The water applying device and the scraper and take a variety of different configurations, such as shown in the prior Goldstein patents, the details of which are not important.

Referring now to the drawings, FIG. 1 is perspective view of an ice machine 10 according to one embodiment of this invention. The ice machine 10 can be used for making flake or slurry forms of ice.

Figure 3:
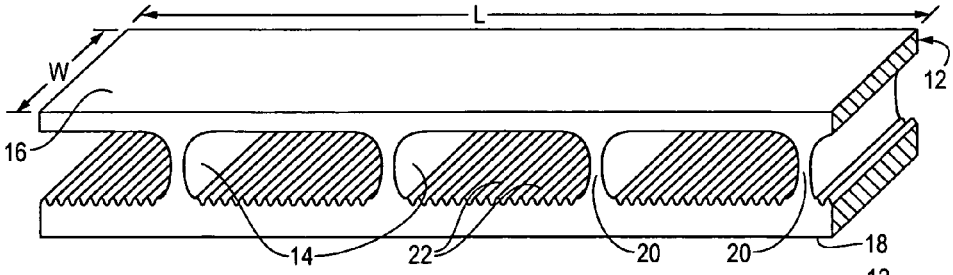
FIG. 3 is a perspective view showing a section of an extruded panel which forms the heat exchanger of FIGS. 1 and 2, having internal passages for refrigerant. The panel of FIG. 3 is extruded in a rectangular format and then subsequently pressed, rolled or otherwise formed into a cylindrical arrangement as shown in FIGS. 1 and 2. The panel is preferably made from an extruded aluminum alloy.
Figure 4:
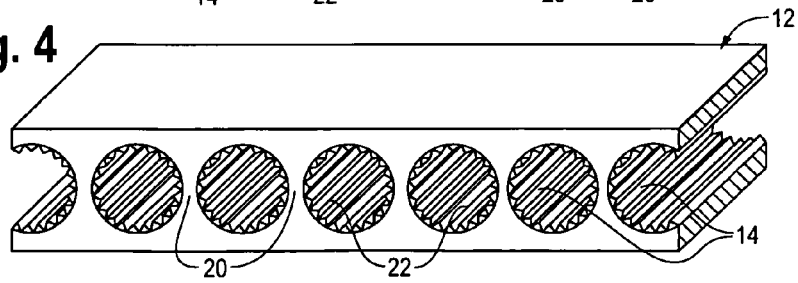
FIG. 4 is a perspective view showing an alternative arrangement of the extruded aluminum panel of FIG. 3.

The ice machine includes a cylindrical heat exchanger 12 in the form of a drum. The heat exchanger 12 includes inner and outer cylindrical walls 16 and 18, respectively. Refrigeration passages 14 shown in dashed lines are provided between the walls 16 and 18 for flow of a refrigerant. The inner and outer walls 16 and 18 are separated from each other by wall or web-like connecting structures 20 which define the refrigeration passages 14. These connecting structures 20 are best shown in FIGS. 3 and 4 and will be described below. The refrigeration passages 14 optionally include a multitude of raised and recessed features 22 (see FIGS. 3, 4) such as corrugations or other type of surface increasing the surface area of the refrigeration passages 14 thereby enhancing the heat transfer characteristics of the heat exchanger. The raised and recessed features 22 are typically formed on the wall of the refrigeration passage which receives the water from a water application device; thus in the embodiment of FIG. 1 the raised and recessed features 22 are formed in the passage 14 on the wall 18, as shown in FIG. 3.

As shown in FIG. 1, the ice machine 10 further includes a source (not shown, conventional) of refrigerant and refrigerant circuitry 30 delivering the refrigerant to the refrigeration passages in the heat exchanger. The circuitry 30 includes an inlet conduit 32 which is connected to an inlet 34 in the heat exchanger 12 for allowing substantially liquid phase refrigerant to enter into the internal refrigeration passages 14 of the heat exchanger 12. The circuitry also includes a return conduit 36 which is connected to an outlet 38 of the heat exchanger which carries refrigerant back to a compressor and then to a condenser (both not shown, conventional) which condenses the gas-phase refrigerant back to a liquid phase. The refrigeration system operates in a closed loop in conventional fashion. The details are known in the art and therefore omitted from the present discussion.

Only one inlet 34 and outlet 38 are shown connecting the conduits 32 and 36 to the heat exchanger 12. More than one inlet and outlet may be provided, depending on the design of the heat exchanger passages and whether the refrigerant circulates in one circumferential pass, less than one circumferential pass, or in multiple circumferential passes. In the design of FIG. 1, the refrigerant circulates in multiple circumferential passes around the circumference of the heat exchanger before exiting the outlet 38. In this design, there may for example be 5 or 10 of such inlets 34 and outlets 38 for the heat exchanger, depending on its axial length.

The machine 10 further includes a device 40, such as a nozzle or set of nozzles, for providing water to the heat exchanger wall 16. The water may be applied as a spray or stream of water 42. The manner in which the device 40 operates can vary widely and the details are not particularly important. For example the water application device 40 can take any of the various constructions shown in the prior art patents cited previously.

The machine further includes a device 50 such as scraper or reamer having a blade edge 52 which is positioned closely adjacent to the exterior wall 18 of the heat exchanger for removing ice formed on the wall 18. Relative rotational motion occurs between the heat exchanger 12 and the water application device 40 and scraper 50. In one possible configuration the water source 40 and blade 50 rotate as a unit together around the periphery of the heat exchanger while the heat exchanger 12 remains stationary. Alternatively, the heat exchanger 12 rotates about the central longitudinal axis 58 while the water spray device 40 and scraper 50 remain stationary. In either case, such rotation causes the scraper 50 to remove ice 54 from the wall 18 of the heat exchanger. The ice is accumulated in any suitable container or hopper 56. While the ice machine 10 of FIG. 1 is shown in a vertical configuration, it can also be arranged in a horizontal configuration.

Figure 2:
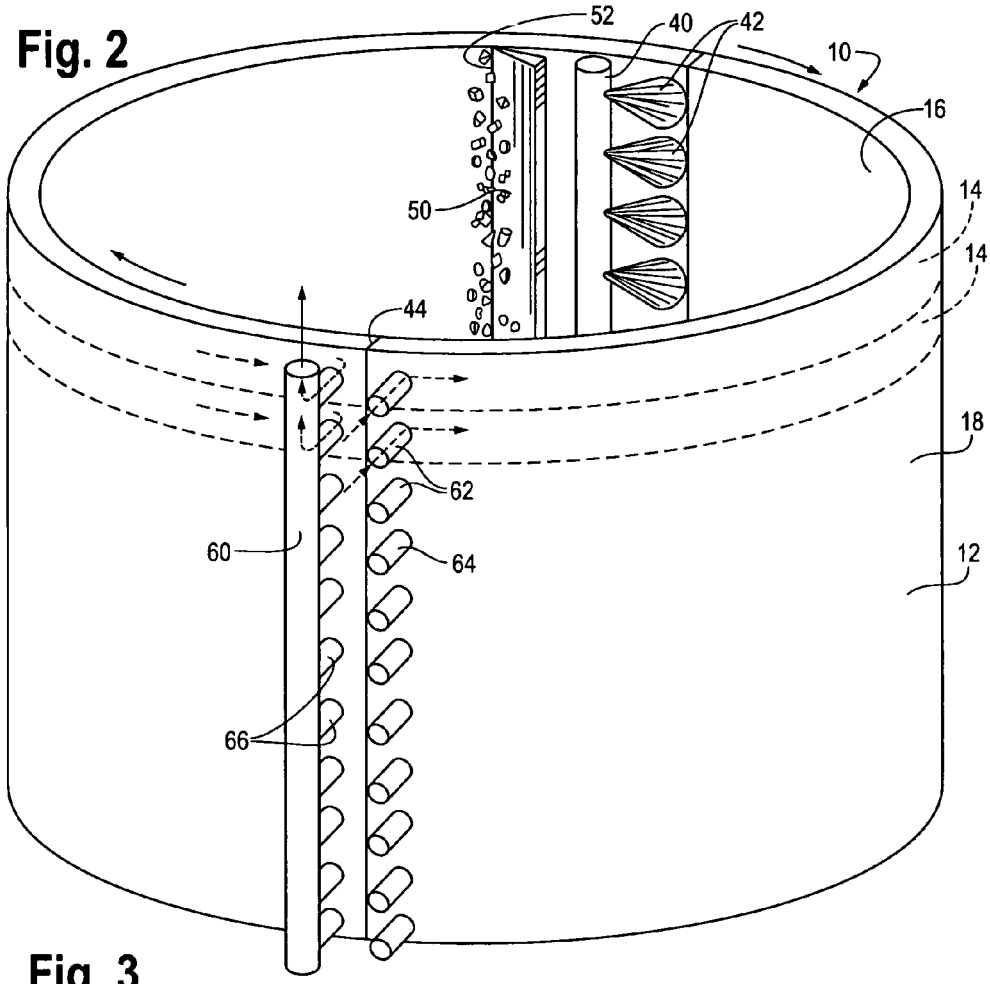
FIG. 2 is a perspective view of an alternative embodiment to the design of FIG. 1.

As another alternative, in a slurry ice machine embodiment, the water application device introduces water into the interior of the heat exchanger 12 cylinder and fills the interior of cylinder, similar to the configuration of FIG. 2. The interior of the cylinder includes one or more dashers or other rotating devices which sweeps along the interior surface of the heat exchanger in contact with the water to remove ice or ice crystals. The dasher removes ice crystals and/or super-chilled water from the surface of the heat exchanger and ice crystals form on the heat exchanger surface and/or in the water. The ice is carried off as a slurry. Water is supplied to the heat exchanger interior at the same rate that the slurry is formed and carried off. An alternative configuration would be to place the cylinder in a larger vessel with water present on the exterior of the cylinder, and a dasher rotates around the exterior of the cylinder to remove ice or super-chilled water from the exterior surface and ice is carried off in a slurry.

In a further possible embodiment, the slurry ice machine could have water present on both the interior and exterior surfaces of the heat exchanger cylinder and have dashers present to remove ice or super-chilled water from both the exterior and interior surfaces, essentially combining the features of the above two embodiments. This is an example of a "double duty" slurry ice machine. Further examples of "double duty" ice machines are described below in conjunction with FIGS. 15-17.

A flake ice machine is also envisioned which includes a water application device and an ice removal device configured and arranged on both the internal and external surfaces of the heat exchanger 12, essentially combining the features of the embodiments of FIGS. 1 and 2. In such a device, the refrigerant fluid circuitry could be arranged to supply refrigerant to the heat exchanger and remove refrigerant from the heat exchanger at either the top or bottom ends (or both) of the heat exchanger, using the cylindrical or arcuate heat exchanger configurations of FIGS. 5, 6, 13, 14, 15 and 17. The water application and ice removal devices are mechanically coupled to rotate around the interior and exterior of the heat exchanger. The "double duty" ice machine construction can use a conventional ice drum or cylinder manufactured as a pressure vessel or otherwise, or one of the cylinders made from an extrusion of a metal as described herein.

Figure 5:
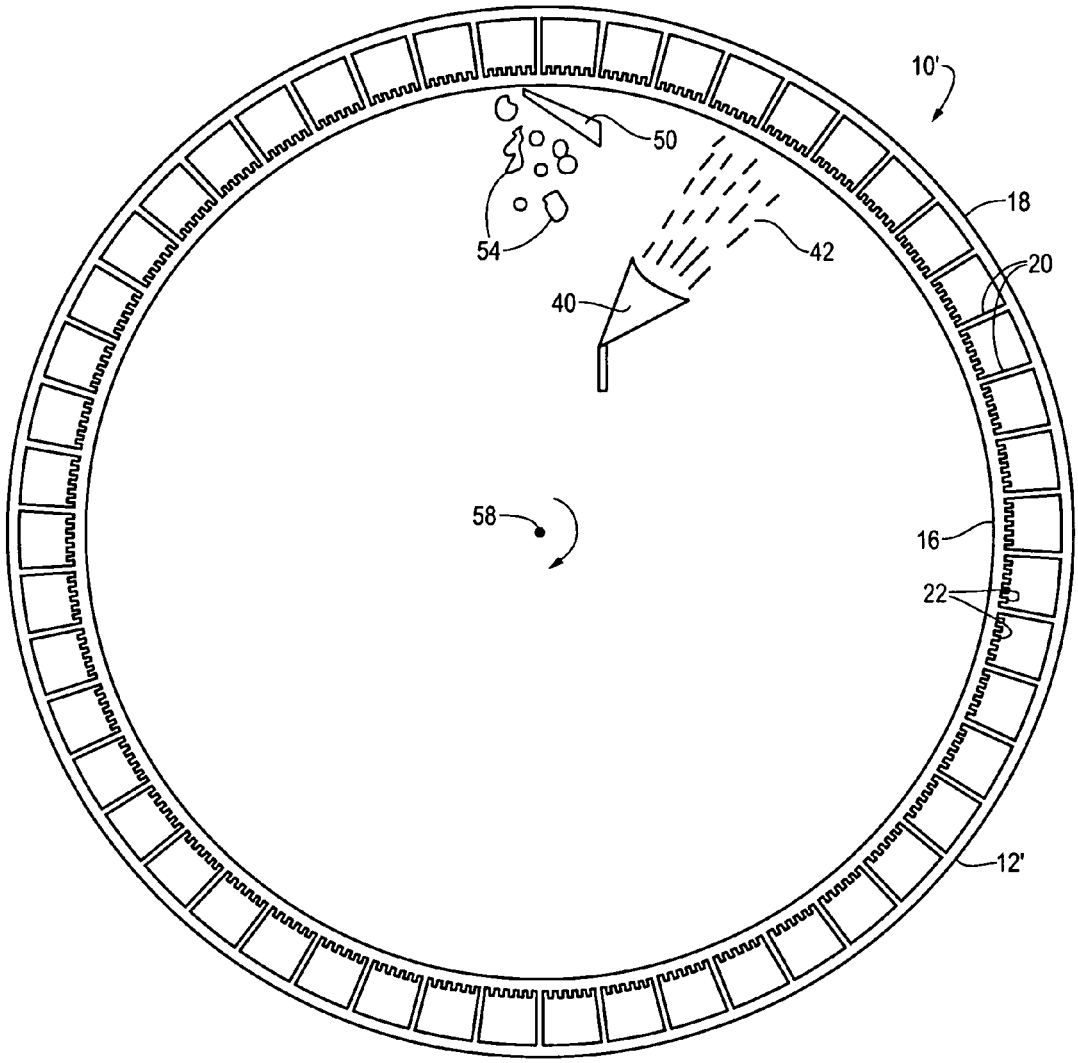
FIG. 5 is an end view of an extruded aluminum panel which is extruded in a cylindrical arrangement. The extrusion can be extruded to any convenient length and the extrusion cut to desired length.
Figure 12:
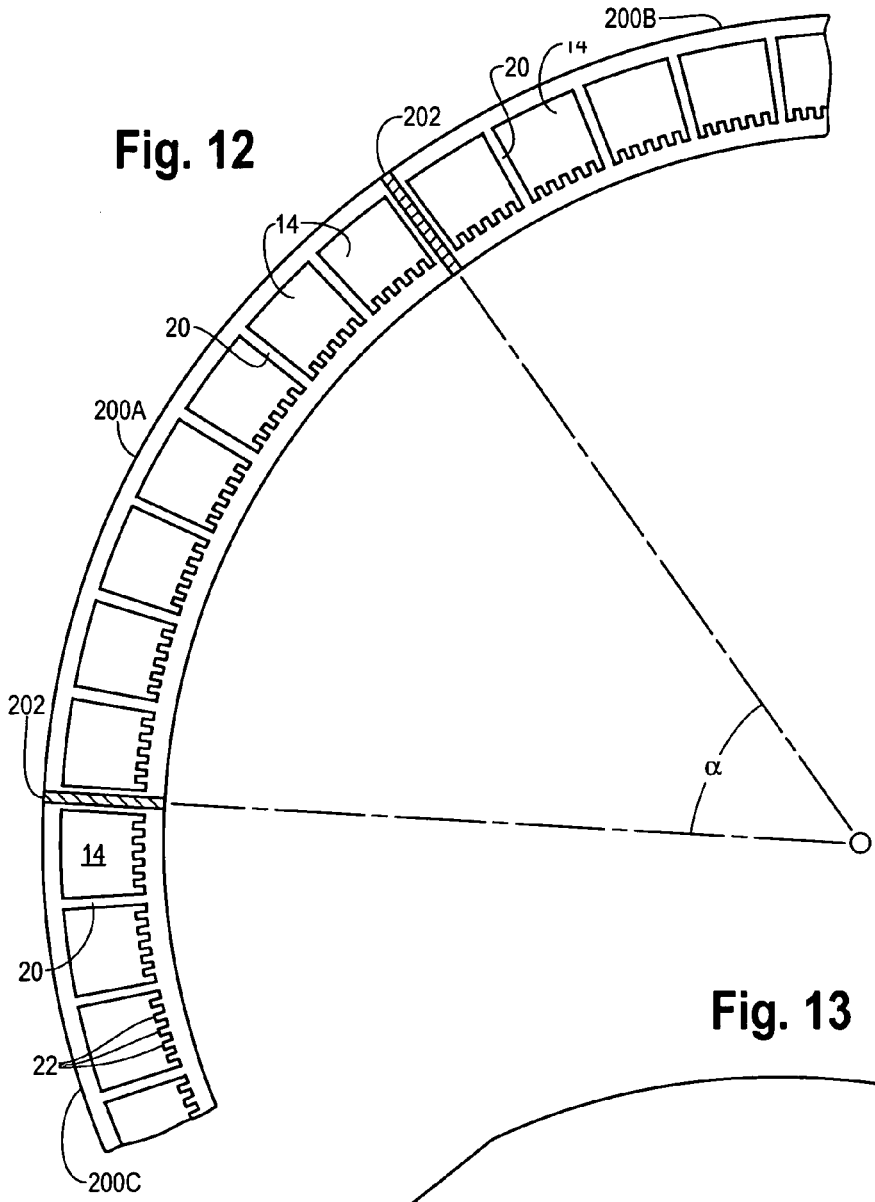
FIG. 12 is an end view of several arcuate extruded sections edge welded to each other to form a cylindrical configuration. Each section could be either extruded in the arcuate form or alternatively extruded in a planar (flat) form and then bent or otherwise formed into arcs.
Figure 13:
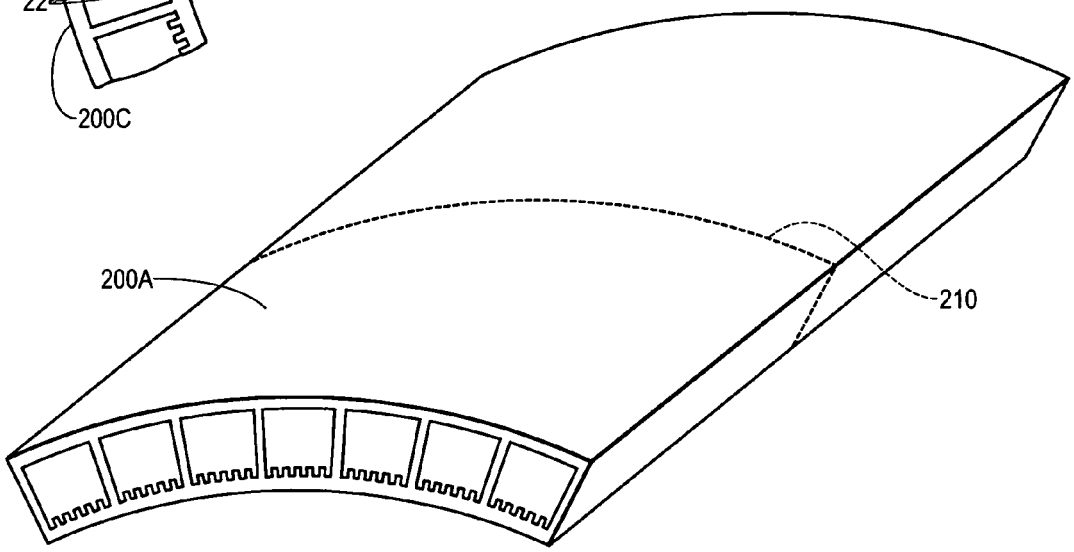
FIG. 13 is a perspective view of one of the extruded arcuate heat exchanger sections of FIG. 12.

The heat exchanger 10 (including walls 16, 18 and internal passages 14) is preferably constructed from an extrusion of a heat conductive metal, preferably but not necessarily an aluminum alloy. This extrusion can take the form of a rectangular panel which is then formed into a cylindrical arrangement shown in FIG. 1. Alternatively, the extrusion can be in cylindrical form (see FIG. 5) of any arbitrary length. Alternatively, the extrusions can also have an arcuate form (see FIGS. 12 and 13) and several of such arcuate cylinder segments joined to each other at their edges to form a cylinder. The features of the heat exchanger and method of manufacture thereof will be described in further detail below. In the embodiments of FIGS. 5, 12 and 13, a cover or end cap, not shown is fitted (e.g., by welding) to the ends of the heat exchanger to close off the refrigeration passages.

Figure 11:
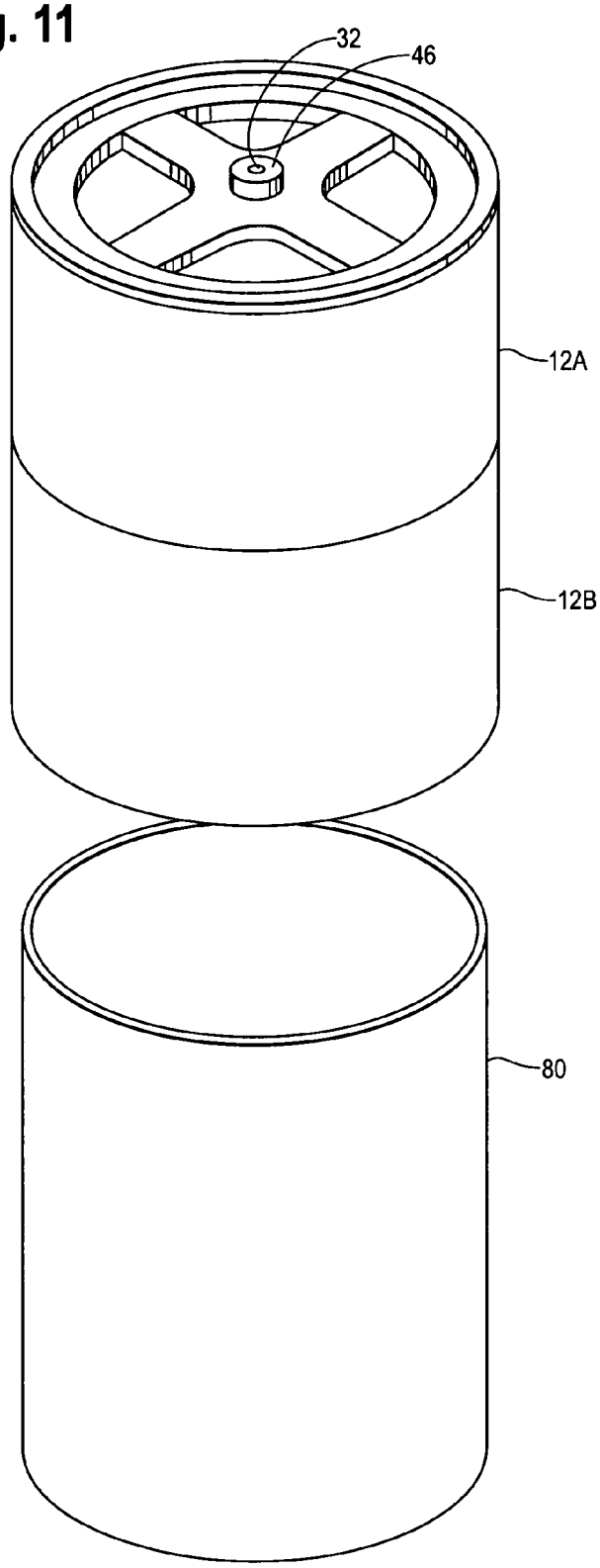
FIG. 11 is a perspective view showing two cylindrical heat exchangers butted in longitudinal alignment and brought into proximity with each other in that configuration, and a stainless steel shell which is fitted over the abutted heat exchangers.

In one possible embodiment, the heat changer 12 can take the form of a plurality of individual cylindrical heat exchanger segments having the inner and outer walls 16 and 18, raised and recessed features 22 and refrigeration passages 14 as described above, abutted against each other in a longitudinal arrangement as shown in FIG. 11. If the heat exchanger is formed as arcuate or cylindrical extrusions, the extrusion itself could be of any desired length and typically it would be cut to the desired length for the drum, rather than have segments abutted end to end as shown in FIG. 11.

In the embodiment of FIG. 1, the heat exchanger 12 is constructed as rectangular extruded panel which is formed into a cylinder and the edges of the panel joined together or otherwise brought into proximity. In one possible configuration, the edges are joined via welding or mechanical fastening at a seam 44. They need not be welded or joined to each other. A pipe or hollow tube 46 is used for both the return conduit 36 for returning refrigerant gas and as the shaft around which the cylinder heat exchanger 12 rotates. Liquid refrigerant enters through tube 32, then is distributed evenly to one or more circuits (fluid passages 14) through distributor 47 to each conduit 32 into refrigerant channel entrance 34 and into the passages 14, where it cools the ice forming surface 18 as it passes through channels 14, out return tube 36, into a common return gas header and shaft 46. Note that the refrigerant circulating through the heat exchanger 12 makes multiple passes around cylinder before exiting through tube 36. This longer circuit can be beneficial with direct expansion type refrigeration systems commonly used in smaller and commercial applications. This ice machine refrigerated surface allows circuit length to be varied and optimized for particular applications.

Thus, as shown in FIG. 1, the preferred embodiment of the ice machine, the heat exchanger 12 with refrigerated surface 18 is constructed from an extruded aluminum panel with multiple internal passages 14 for circulation of a refrigerant. A typical panel might be 24 in. wide and 1.6 in. thick with 0.8 in.×1.4 in. channels separated by 0.2 in. thick connecting structures 20. An alternate channel design might be round, as shown in FIG. 4. The top and bottom surfaces 16 and 18 could be of different thicknesses when beneficial. These panels would be formed into cylinders either transverse to or parallel to the refrigerant passages 14 by rolling, press break or other methods known in the industry. Once formed in to a cylindrical configuration, the connecting structures 20 within the open ends would be either cut back to accommodate a welded end cap tight fitting against the edges of the ends of the cut back connecting structures 20, or alternating connecting structures 20 could be cut back sufficiently to provide a passage inside the cap for refrigerant to flow down one channel across to an adjacent channel and back the reverse direction. This circuit arrangement could be varied to optimize refrigerant circuit length and flow routing to provide the best performance for a given application. Thus, the end cap welded to the edges of the panel can serve a function to control the flow of the refrigerant in the passages 14, e.g., either to reverse the flow from one channel to another or to connect channels on opposite sides of the seam to allow for multiple passes of refrigerant.

Once formed into a cylinder, the panel ends could be joined or otherwise brought into proximity and then machined to create a true round dimensioned surface for the ice production. The ice forming surface (exterior surface of wall 18 in FIG. 1) could be coated with industrial Teflon or other non-corrosive and protective surface. Alternatively, a shell or liner in the form of a relatively thin cylinder of stainless steel or other suitable metal dimensioned for an interference fit inside or outside the refrigerated surface could fitted to create a corrosion resistant ice forming surface. This stainless steel liner would not have the structural requirement of a pressure vessel and could be relatively thin and therefore impact heat transfer minimally.

Inside the channels or passages 14 forming the refrigerant passages, an enhanced heat transfer profile provided by the raised and recessed regions 22 can be economically produced by virtue of the extrusion process, in the channel 14 wall, adjacent to the ice-forming surface 18, as shown in FIG. 3. The enhanced surface, profiled to facilitate creating nucleate boiling cavities, can also be formed by running a tool through the channels 14 prior to forming a rectangular or arcuate extruded panel into a cylindrical configuration. The extrusion process provides for great flexibility in channel design, enhancement design, and overall panel design. Aluminum can be produced in a temper allowing greater forming flexibility than tempered after forming and welding to increase strength and rigidity. Aluminum extruding process provides great length flexibility and can be stocked as uncut blanks. Cylinder segments can be abutted end to end with a common longitudinal axis to make a longer ice machine or cut back to make shorter ones.

In one possible manufacturing method, the following steps are performed to make the heat exchanger 12:

1. a relatively soft T4 aluminum alloy is extruded into a rectangular panel with the internal passages 14 and connecting webs 20,
2. optionally, a tool is run through the internal passages to provide the enhanced heat transfer surface 22,
3. any necessary cutting back of the edges of the webs of the panel is performed (See FIGS. 8, 9),
4. end caps (described below) are then welded to the edges of the panel,
5. the panel is bent or otherwise formed into a cylinder and joined as may necessary by fastening or welding to maintain the cylindrical configuration, and
6. the cylinder is delivered into an oven for heat treating to increase the temper of the alloy.

In a variation of this method, the panel is formed into slightly less than 360 degrees of the circumference of the cylinder, with a slight gap in the circumference of the drum, say 10 degrees or so. The manifold of FIG. 14 described below is welded into the gap to complete the drum.

In another exemplary method, the heat exchanger is formed in the following steps:

1. A relatively soft T4 aluminum alloy is extruded into 120 degree arcuate segments with the internal passages 14 and connecting webs 20, and three of such extrusions are obtained to any arbitrary length (e.g. 20 feet). See FIGS. 12, 13.
2. The edges of the arcuate segments joined (e.g., by welding or using metal fasteners) to each other as shown in FIG. 12 to form a cylinder of 20 feet length.
3. Optionally, a tool is run through the internal passages in the segments to provide the enhanced heat transfer surface 22.
4. The cylinder is cut to a desired length (e.g., four five foot lengths, each five foot section eventually becoming a heat exchanger for an ice machine).
5. Any necessary cutting back of the edges of the webs is performed to provide for recirculation of refrigerant from one passage to the adjacent passage.
6. End caps are welded to the end faces of each of the cylindrical drums to close off the refrigeration passages.
7. The cylinders are delivered into an oven for heat treating to increase the temper of the alloy.
8. After heat treating, inlets and outlets for refrigerant are formed in the cylinder per the requirements of the heat exchanger.

Steps 2 and 4 can be performed in the opposite order, i.e., the arcuate extrusions are cut to the desired length and then joined to each other, e.g., by welding.

FIG. 2 is a perspective view of an alternative embodiment of an ice machine 10. In FIG. 2, the water application device 40 and the scraper 50 are placed in the interior of the heat exchanger and the circuitry 30 supplying refrigerant to the passages 14 in the heat exchanger 12 is positioned on the exterior of the heat exchanger 12. The heat exchanger 12 takes the form of a rectangular extruded aluminum alloy panel which is press or roll formed into a cylinder with the edges joined together at a seam 44. A pipe or hollow tube 60 carries return refrigerant back to the refrigeration system. Refrigerant 62 enters through tubes 64 then into refrigerant channels 14 where it cools the ice-forming surface 16 as it passes through channels 14 toward and out return tubes 66 into common return header 60. In this example, the refrigerant makes only one pass around the cylinder 12. This feature would be desirable where low refrigerant pressure drop through channel 14 is beneficial, such as where a flooded or liquid overfeed type refrigeration circuit is used in larger industrial systems. The ice machine of FIG. 2 is shown in a vertical arrangement, but it could also be oriented in a horizontal arrangement.

FIG. 3 is a perspective view showing a portion of an extruded panel 12. The panel has internal passages 14. The panel of FIG. 3 is extruded in a rectangular format and then subsequently pressed, rolled or otherwise formed into a cylindrical heat exchanger arrangement as shown in FIGS. 1 and 2. The panel 12 is preferably made from an extruded aluminum alloy. FIG. 3 shows the connecting structures 20 which connect the walls 16 and 18 together and provide structure defining the passages 14. Internal raised and recessed features 22 may be provided to optimize the heat transfer profile in the channels 14. The features 22 can be formed either after extrusion (by means of running a tool through the channels) or they can be part of the extrusion as shown in FIGS. 5 and 12.

FIG. 4 is a perspective view showing an alternative arrangement of the extruded aluminum panel 12 of FIG. 3, in which the channels 14 have a circular or oval cross-sectional shape. Again, the internal raised and recessed features 22 providing the optimized heat transfer profile can be formed in the channels 14 either after extrusion (by means of running a tool through the channels) or they can be part of the extrusion.

FIG. 5 shows an end view of an ice machine 10 which incorporates a heat exchanger 12' in the form of an extruded aluminum panel which is extruded in a cylindrical arrangement. The extrusion can be extruded to any convenient lengths, and then cut to the desired length needed for a given ice machine. FIG. 5 also shows the optional surface features 22 in the refrigerant passages 14 that increase the heat transfer efficiency of the heat exchanger 12'. In the embodiment of FIG. 5, the features 22 are formed in the wall 16, the exterior surface of which is the ice forming surface. The ice machine includes a water application device 40 and a scraper 50. Note that the wall 16 is thicker than the wall 18 and that the heat exchanger passages 14 are oriented in alignment with the longitudinal axis 60 of the heat exchanger. FIG. 5 does not show the circuitry supplying and withdrawing refrigerant to and from the passages 14 but it can take the form of the circuitry shown in FIG. 1 or 2, modified such that the circuitry introduces refrigerant at one end of the passages 14 and removes it from the other end. An end cap (not shown) is welded onto the ends of the extrusion to close off the passages 14 and optionally provide for circulation from one passage to an adjacent passage. Alternatively, the circuitry could introduce the refrigerant at one end and withdraw the refrigerant at the opposite end. As another alternative, the refrigerant could be introduced at one end, flow to the opposite end and into the adjacent passage and then flow down the adjacent passage to the end. The number of passages that the refrigerant flows along that are optimum could for a given design, vary from 1, 2 or even 10 depending on the application.

Referring to FIGS. 12 and 13, the extrusion may also take the form of an arcuate cylindrical segment 200, and segments 200A, 200B, 200C etc. abutted and welded to each other at the edges as indicated by welds 202 in FIG. 12 to form a cylinder. The angle of the arc (defined by angle $\alpha$) is typically 90 degrees, 120 degrees, 60 degrees, or some other value such that an integer number of identical segments 200 can be combined (by welding or mechanical fastening) to form a complete cylinder.

Figure 6:
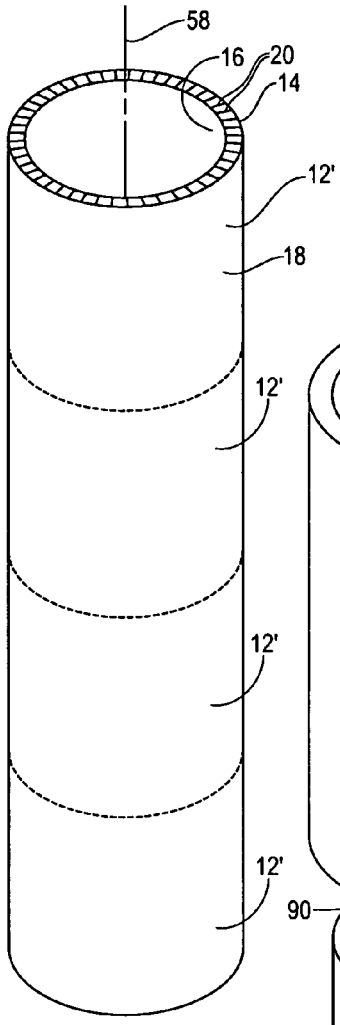
FIG. 6 shows a cylindrical extrusion which can be cut into four separate heat exchangers.

FIG. 6 shows an elongate cylindrical extrusion which is subsequently cut into four individual cylindrical extrusions 12', each of which are of the desired length for a given ice machine.

Figure 7:
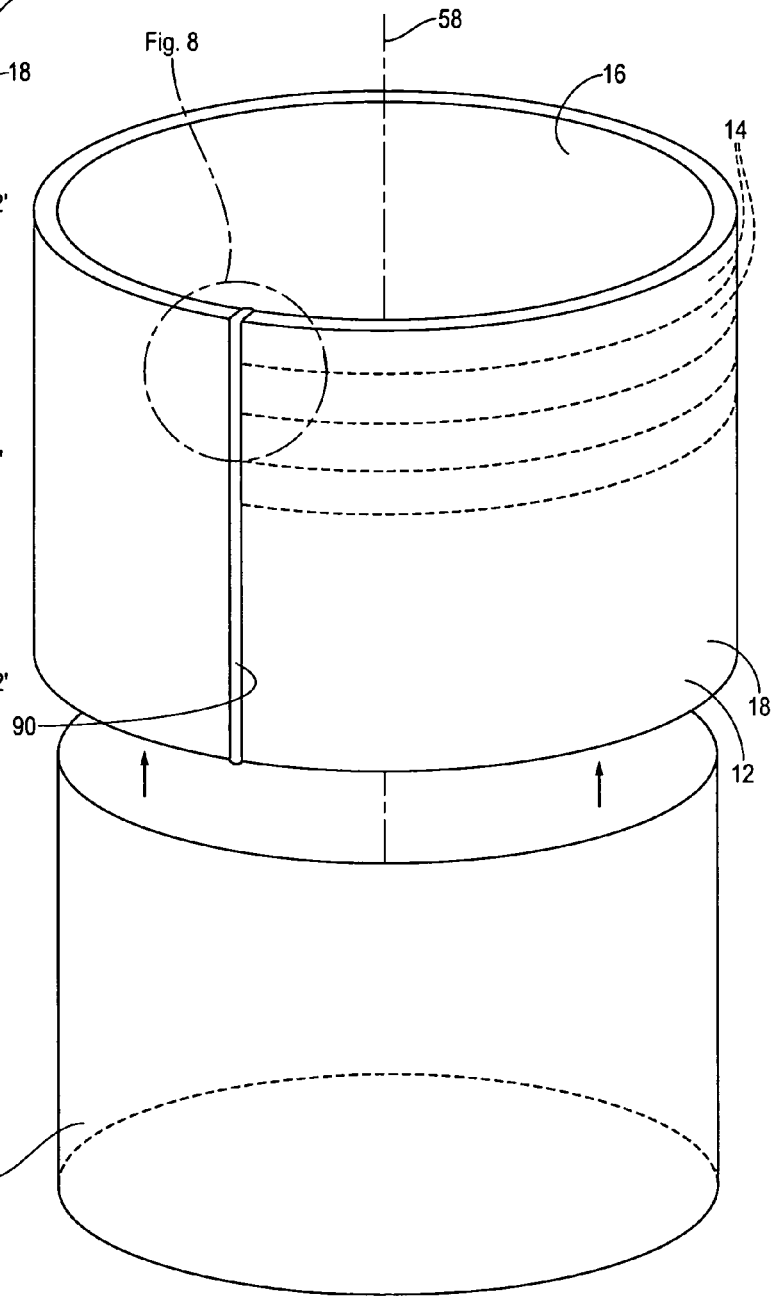
FIG. 7 is a perspective view of a heat exchanger similar to that shown in FIGS. 1 and 2, in which a metal shell, e.g., stainless steel or titanium, is fitted against either the exterior or interior wall of the heat exchanger. The metal shell forms the surface of the heat exchanger that receives the water from the water application device, and is therefore the surface that is scraped by the scraper or other device to remove the ice from the heat exchanger. The shell of FIG. 7 can be applied to the heat exchanger of FIGS. 5 and 6. Industrial Teflon or other protective coating such as chromium plating can be used in place of the metal shell shown in FIG. 7.
Figure 15:
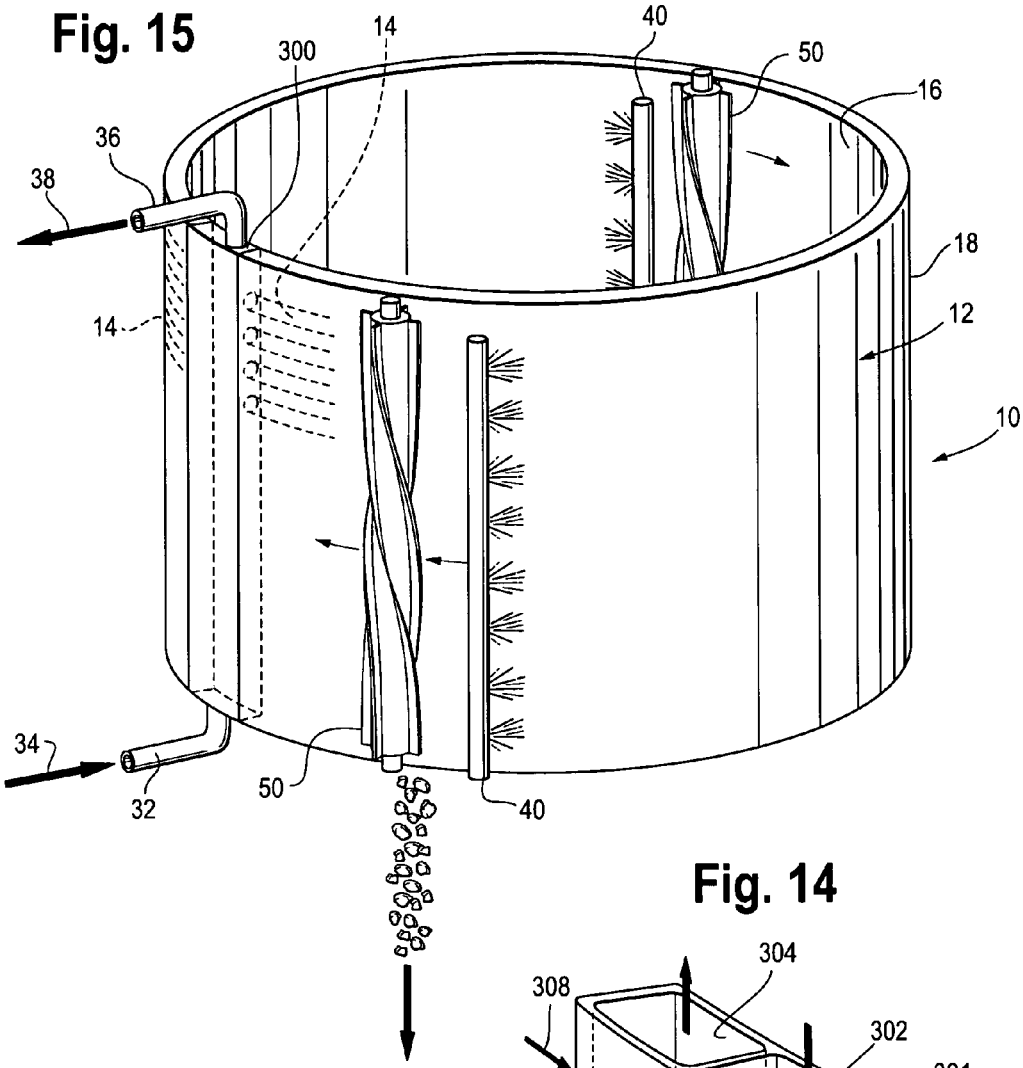
FIG. 15 is a perspective view of a "double duty" ice machine having the manifold of FIG. 14. Water is applied to both the internal and external surfaces of the heat exchanger, and each surface has a scraper or reamer to remove ice formed on the surface.

FIG. 7 is a perspective view of a heat exchanger similar to the designs shown in FIGS. 1 and 2, in which a metal shell or liner 80, e.g., stainless steel, is fitted against either exterior 18 or interior wall 16 of the heat exchanger 12. The metal shell 80 forms the surface of the heat exchanger that receives the water from the water application device, and is therefore the surface that is scraped by the scraper to remove the ice from the heat exchanger. The shell 80 of FIG. 7 can be applied to the heat exchanger 12' of FIGS. 5 and 6. In the embodiment of FIG. 15, both the inner and outer walls 16 and 18 of the heat exchanger 12 could be fitted with a metal shell 80, as shown in FIG. 7.

Figure 8:
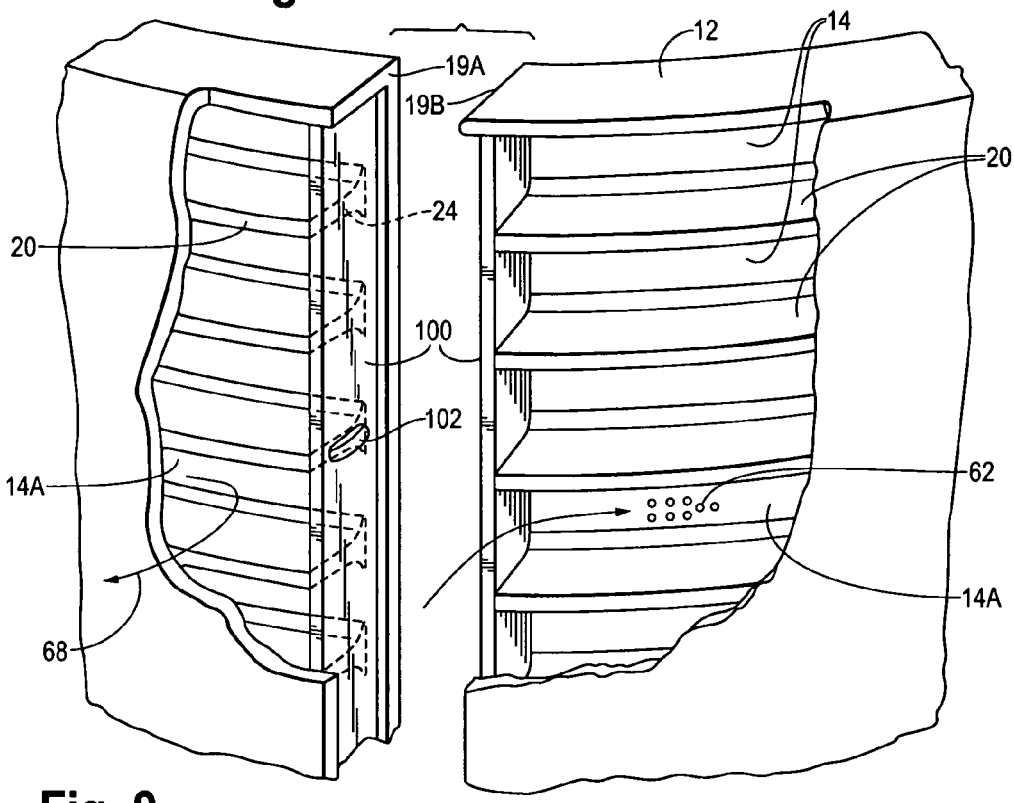
FIG. 8 is a detailed perspective view of the portion of the heat exchanger of FIG. 7, partially in section, showing the region where the two edges of the panel are joined together when the extruded panel is formed into the cylindrical configuration. In the embodiment of FIG. 8, an end cap is fitted to the edges of the panel.

FIG. 8 is a detailed perspective view of the portion of the heat exchanger 12 of FIG. 7, partially in section, showing in detail the region where the two edges 19A and 19B of the panel are joined together when the extruded panel is formed into the cylindrical configuration. In the embodiment of FIG. 8, an end cap 100 is fitted to the edges of the panel to form this joint. The refrigerant fluid circuit for the design of FIG. 8 is similar to the design of FIG. 2, in that multiple passes of the refrigerant around the circumference of the heat exchanger occurs. The panel wall 18 is shown partially broken away to show the channels 14. The ends 24 of the connecting structures 20 have been cut back from the edge 19A and 19B of the panel uniformly and accurately so that an end cap 100 fits tightly against the ends 24 of the connecting structures, substantially blocking refrigerant from passing from one channel 14 to the adjacent cannel 14 thereby forming separate refrigerant channels. The cap 100 can be perimeter welded around the edges 19A, 19B of the panel and if needed plug welded as indicated at 102 to the ends 24 of the connecting structures 20. In this single pass circuit, refrigerant liquid 62 would enter channel 14A, make one pass around the circumference of the cylinder, and exit the cylinder as indicated by the arrow 68, as a gas or gas/liquid mixture.

Figure 9:
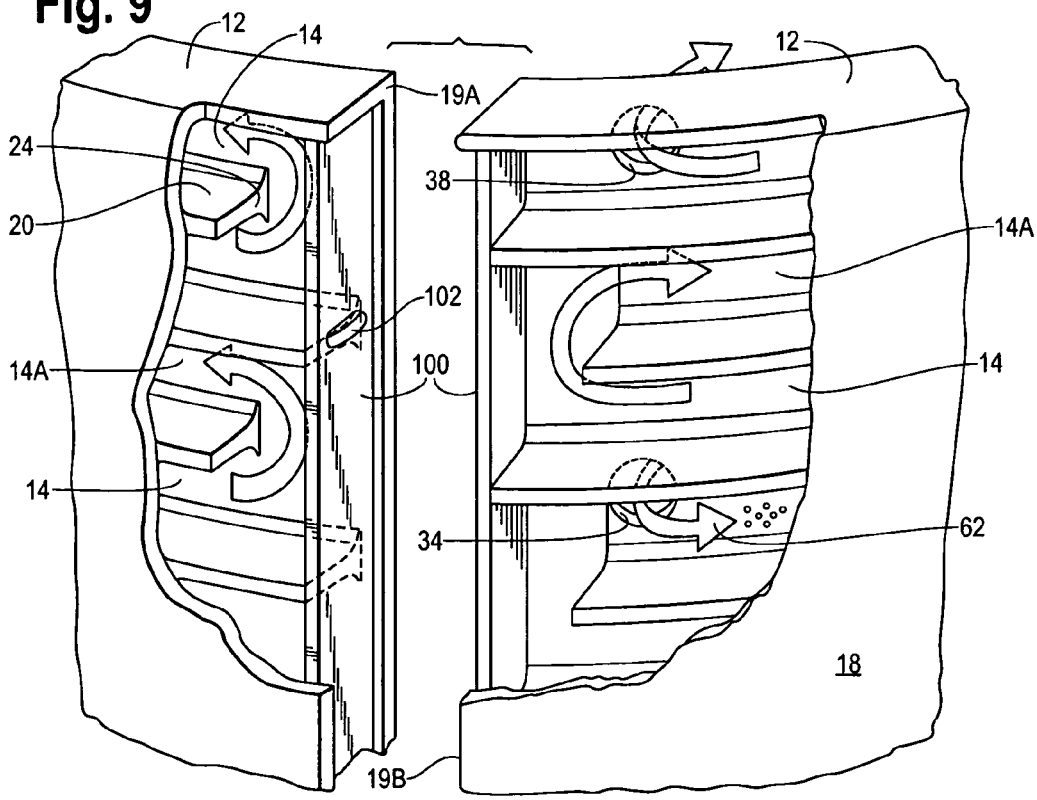
FIG. 9 is an illustration of an alternative embodiment to the construction of FIG. 8.

FIG. 9 is an illustration of an alternative embodiment to the construction of FIG. 8. FIG. 9 shows a more detailed cutaway of the refrigerant channels 14, where the edges 19A and 19B of the panel 12 join when formed into cylinder. This cutaway circuit is typical of the design of the heat exchanger 12 shown in FIG. 1. The panel wall 18 has been removed to show channels 14. The ends 24 of the connecting structures 20 have been cut back alternately (except where the refrigerant circuit begins and ends) and accurately so that the end cap 100 fits tightly against every other end 24 of connecting channels (as indicated by welds 102), thereby creating a refrigerant passage from one channel 14 to the adjacent channel 14A thereby forming multiple refrigerant channels. The cap 100 can be perimeter welded around the edges 19A and 19B and if needed plug welded at 102 to the non-cut back ends of the channels 20. In this multiple pass circuit, refrigerant liquid 16 would enter a channel 14 at the entrance 34 shown in the lower right of FIG. 9, make four circumferential passes back and forth around the circumference of the cylinder 12, and exit the cylinder at the outlet 38 as a gas or gas liquid mixture.

Figure 10A:
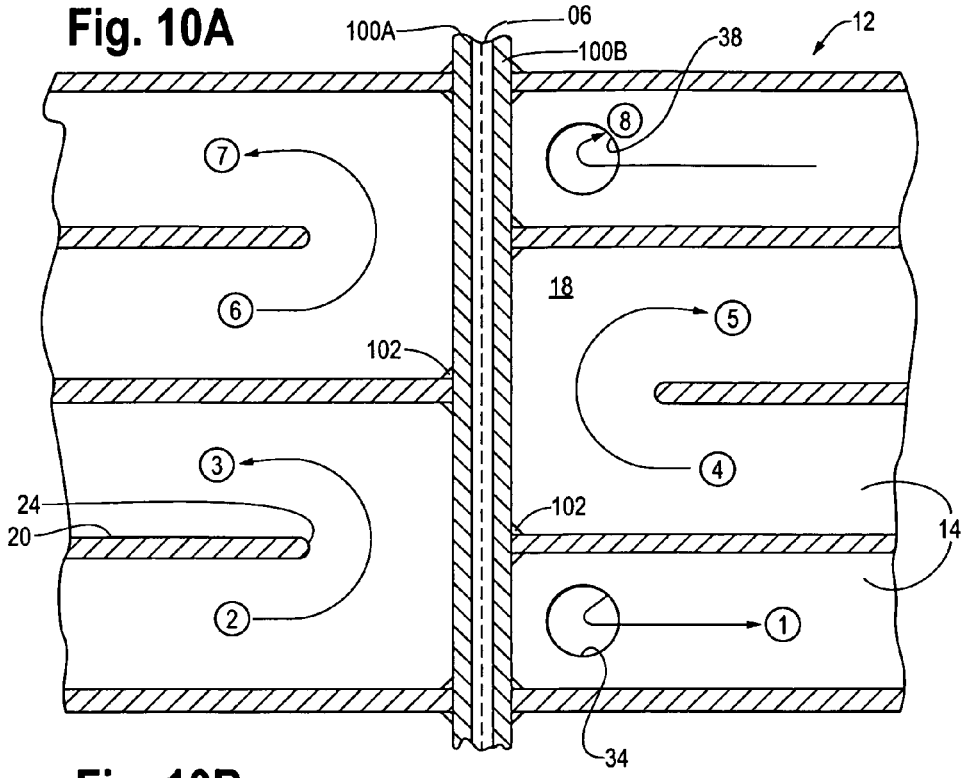
FIG. 10A is cross-sectional illustration of the embodiment of FIG. 9.

FIG. 10A is a schematic illustration of the two edges of the panel and the joint of FIG. 9. The two edges of the panels are welded to an end cap 100 and the end caps 100A and 100B are welded together to form a seam 106. The path taken by the refrigerant as it circulates around the circumference of the cylinder 12 is indicated by the numbers 1-8 in FIG. 10A, and from inspection of the Figure, it will be appreciated that the refrigerant makes four passes around the circumference between the inlet 34 and the outlet 38.

Figure 10B:
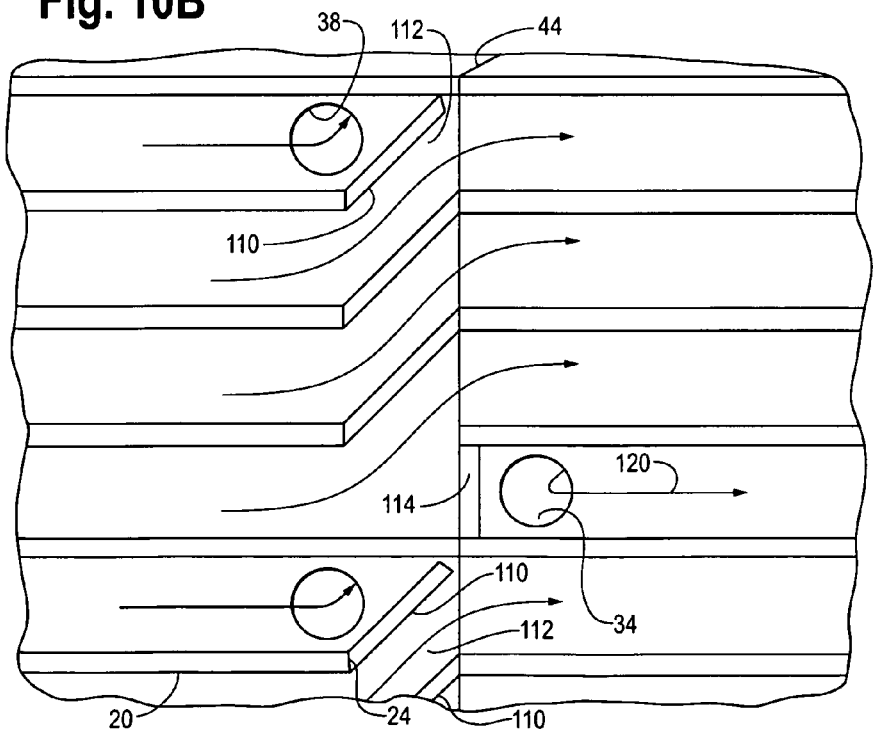
FIG. 10B is a schematic illustration of the region where the two edges of the panel are joined together, showing an embodiment in which there is no endcap and the two edges are welded and sealed together.

FIG. 10B is a schematic illustration of the region where the two edges 19A and 19B of the heat exchanger 12 are joined together, showing an embodiment in which there is no endcap (as in FIGS. 8 and 9) and the welding of the two edges 19A and 19B together forms allow for circulation of the refrigerant through many passes around the periphery of the heat exchanger between the entrance ("in") for the refrigerant and the exit ("out") for the refrigerant. In the design of FIG. 10B, diverters 110 are fit tightly and/or welded in place against the ends 24 of the connecting structures 20 to form refrigerant passages 112 from one channel 14 to the adjacent channel 14. The edges 19A and 19B are welded together at the seam or joint 34. An end wall 114 is placed in the passage 14A next to the entrance 34 to direct refrigerant flow in the direction indicated by the arrow 120. This design the represents an alternate method for forming multiple circuits that pass around the circumference of the cylinder, and the refrigerant flows substantially the same direction. Contrast this to FIG. 10A, in which the refrigerant reverses direction three times as it flows from the entrance to the exit.

FIG. 11 is a perspective view showing two cylindrical heat exchangers 12A and 12B butted in longitudinal alignment and a stainless steel shell 80 which is fitted over the abutted heat exchangers. The principle of abutting heat exchanger segments end-to-end shown in FIG. 11 can be applied to the designs of FIGS. 1 and 2.

Figure 14:
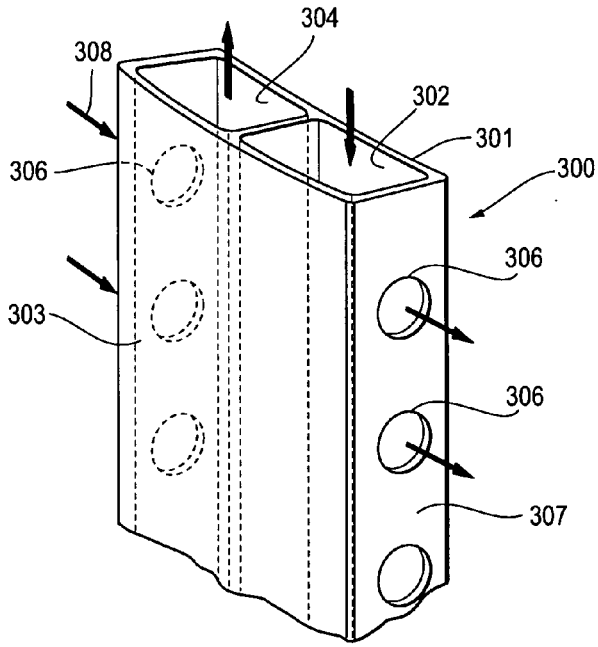
FIG. 14 is a perspective view of a header for introducing refrigerant into a heat exchanger and withdrawal of refrigerant from the heat exchanger. The header is the form of an arcuate section of a cylinder and is welded into place to fill a gap in a cylinder and complete the cylinder.

FIG. 14 is a section view of a two-passage header 300 that provides a means to supply and return refrigerant to one or more circuits within a heat exchanger cylinder 12. The header is configured with arcuate walls 301 and 303 having a common center, such that the inside and outside walls 301 and 303 respectively form a continuation of and become a part of the ice forming cylinder walls 16 and 18 when welded or otherwise attached into the cylinder, see FIG. 15. The header includes a passage 302 for flow of refrigerant to internal passages 14 in the heat exchanger 12 (FIG. 1), and a second passage 304 for return of refrigerant 308 from the heat exchanger. One or more ports 306 can be cut into the sidewalls 307 of the header aligning with and communicating with one or more refrigerant circuit passages within the cylinder walls. The header 300 is one method for providing a means to supply and return refrigerant to an ice forming drum where both the inside and outside walls 16, 18 of the cylinder or drum are used for ice production as in the embodiments of FIGS. 15-17. The header 300 can be formed of extruded aluminum. The inside and outside walls 301 and 303 are arcuate segments of similar radius to the ice-forming cylinder such that the header can be welded into a gap in the cylinder to close off the cylinder.

The header shown in FIG. 14 could provide both in and out conduits (as shown) or two or more headers 300 could be used, each header providing an inlet or outlet or both. Additionally, the headers could be connected at both ends, top and bottom.

Additional "Double Duty" Ice Machines

Further embodiments are contemplated in which ice is formed on both the inner and outer walls of the heat exchanger simultaneously. In a flake ice embodiment, a water application device and sprayer are provided for both the inner wall the cylindrical heat exchanger and the outer wall of the heat exchanger. In a slurry ice embodiment, the heat exchanger is positioned in a vessel and water is supplied to the vessel such that the exterior surface of the heat exchanger is substantially immersed in water. Water is also supplied to the interior region of the cylindrical heat exchanger defined by the inner cylindrical wall and fills the interior of the heat exchanger. Dashers or other ice removal devices rotate rapidly around both the exterior and interior surfaces of the heat exchanger walls to remove ice or super-cooled water from both the inner and outer surfaces of the heat exchanger. Ice crystals form on the surface of the heat exchanger walls or in the water within the heat exchanger drum. Ice is suspended within the water and is carried off as a slurry. Water is introduced into the interior of the heat exchanger and into the vessel at the same rate that the slurry is carried off to enable continuous production of slurry ice. In these "double duty" ice machines (both flake and slurry), the refrigerant passages in the heat exchanger typically are arranged to extend from one end of the ice machine to the other, which is enabled by the arcuate or cylindrical extrusions described below.

The "double duty" ice machines, where ice is formed on both the inner and outer walls of the heat exchange, can utilize conventional pressure vessel drums, as well as the improved, extruded drums or cylinders of this disclosure.

FIG. 15 is a perspective view of an ice machine 10 including a heat exchanger cylinder or drum 12 configured for ice production on both inside 16 and outside 18 walls of the cylinder 12. In this embodiment, two ice removing reamers 50 and water application devices 40 are rotated around both the inside and outside walls of the cylinder. The header 300 of FIG. 14 can be welded into the cylinder wall providing a supply and return conduit for refrigerant. Refrigerant circuitry 32 includes an inlet 34 connected to the bottom of the header 30 and an outlet 36 connected to the top of the header 300. Refrigerant enters the bottom of the header and is circulated to passages 14 formed in the cylinder 12 and exits the cylinder via the top of the header 300 via the outlet 36. The design of the header 300 does not interfere with ice formation on both the inside and outside walls of the cylinder. The "double duty" ice removal reamers 50 can take the form of a scraper or other devices commonly used in conventional ice machines. The reamers 50 and water application devices 40 rotate about the walls 16 and 18 of the cylinder 12. Such rotation may be independent (using two independent drive systems), or the rotational movement could be coupled together such that a single drive system is utilized. The provision of the header 300 and entrance and exit conduits as shown for refrigerant does not interfere with the relative motion of the water application devices 40 and reamers 50 over the surfaces 16 and 18.

The "double duty" configuration can be used on ice machine heat exchangers constructed by conventional means, or the extruded heat exchangers disclosed in this invention. A conventionally constructed heat exchanger refrigerant would include supply conduits that could pass through one or both ends of the heat exchanger one or more times.

Figure 16:
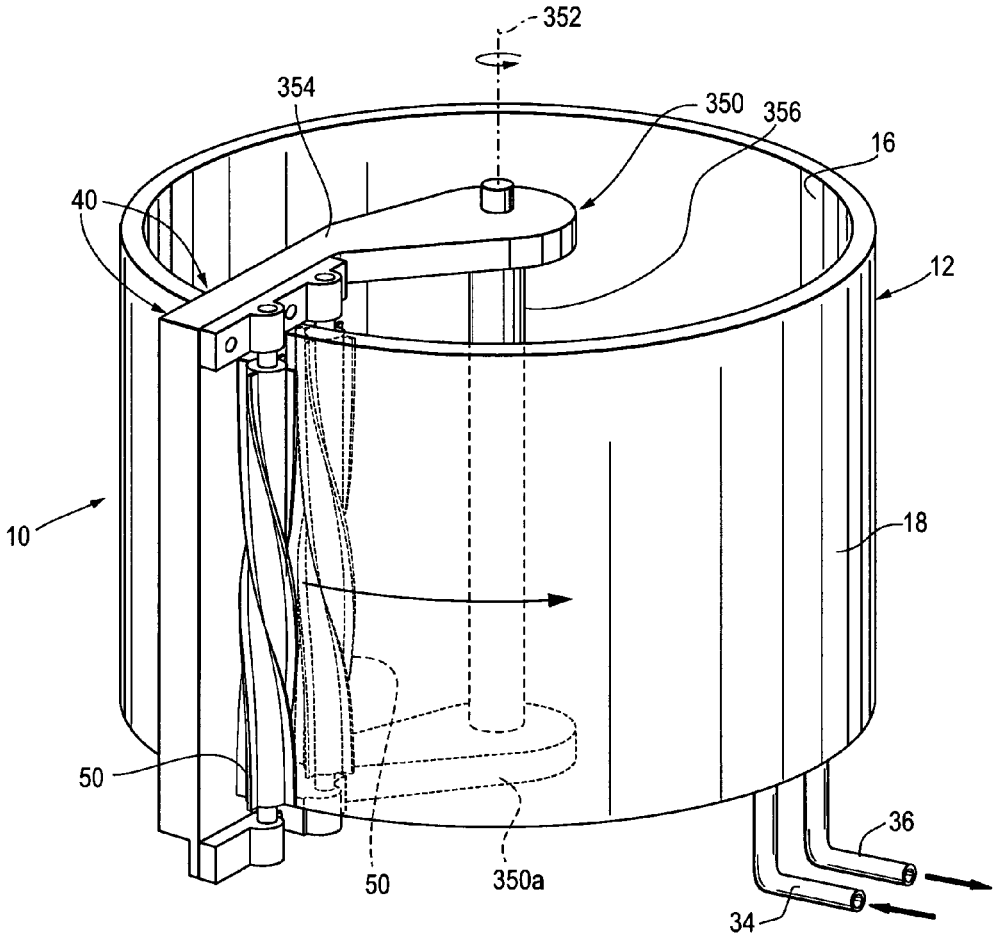
FIG. 16 is an alternative configuration of the "double duty" ice machine of FIG. 15, in which the water application device and reamers for both surfaces are rotated about the internal and external surfaces together by a common drive element aligned with the central axis of the heat exchanger drum.

FIG. 16 is a perspective view of an ice machine 10 where a reamer or other ice removal device 50 and water application device 40 are rotated around both the inside and outside of the ice-forming cylinder. In this embodiment, both the inside and outside ice removal and water application devices are attached to and a part of a structure 350 rotating around the central axis 352 of the ice forming cylinder 12. A motor (not shown) is coupled to the structure which serves to rotate the structure 350 about the axis 352. The structure 350 includes an arm 354 extending over the top of the cylinder to hold or attach the top of the water application devices 40 and the ice removal devices 50. A similar structure 350A to the structure 350 is placed at the bottom of the cylinder. The top and bottom structures 350 and 350A are joined by a tubular shaft 356. The motor (not shown) rotates the shaft 356 about the axis 352 and thus rotates devices 40 and 50 (both sets) about the walls 16 and 18 of the heat exchanger cylinder 12.

Figure 17:
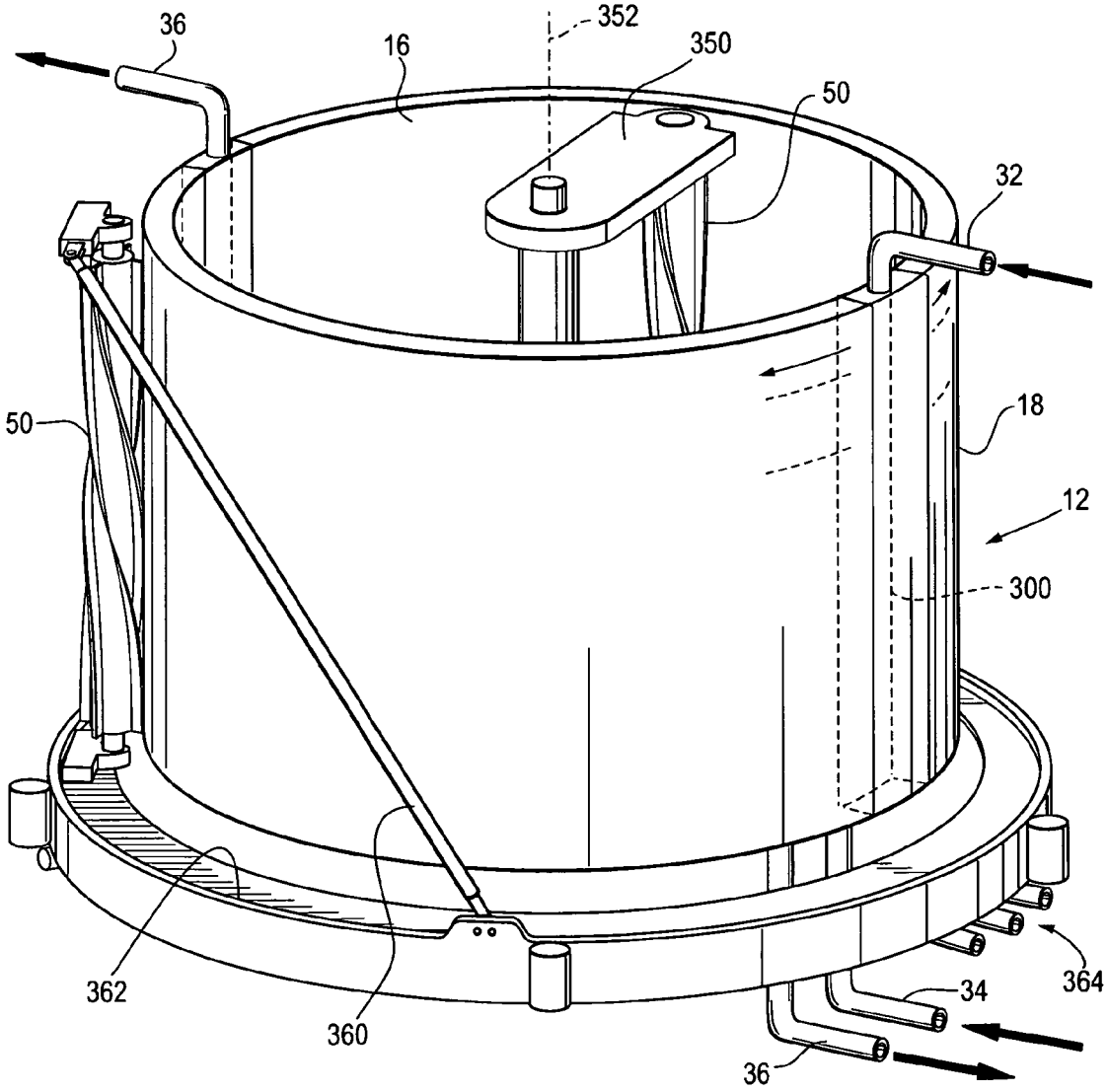
FIG. 17 is an alternative configuration of the "double duty" ice machine of FIG. 16 in which the water application devices for the inner and outer surfaces are driven independently.

FIG. 17 is a perspective view of another embodiment of an ice machine 10 where a reamer or other ice removal devices 50 and water application devices (now shown but present) are rotated around both the inside and outside walls 16 and 18 of the ice-forming cylinder 12. The cylinder 12 includes the header 300 shown isolated in FIG. 14 to provide refrigerant to heat exchanger passages in the cylinder 12. In this embodiment, the ice removal and water application devices are independent of each other, allowing refrigerant conduits 32, 34 and 36 to supply refrigerant to and from opposite ends of the ice-forming cylinder.

In the embodiment of FIG. 17, the water application device and reamer 50 circulating over the exterior wall 18 of the heat exchanger cylinder 12 are positioned on base or ring 362 which rests on rollers 364 or, alternatively, bearings. A tension arm 360 is coupled between the base 362 and structure at the top of the reamer 50 so as to correctly position the reamer 50 closely spaced from the surface 18 of the cylinder 12. A drive mechanism rotates the base 362 such that the reamer 50 moves about the surface 18 of the drum. The drive mechanism could use toothed gears, a drive chain or belt, or other technique known in the art to rotate the base 362. A separate drive mechanism rotates the structure 350 about the center axis 352 of the drum to thereby cause the reamer 50 and water application device (not shown) to move about the inner wall 16 of the cylinder 12. Thus, in the embodiment of FIG. 17 there are two independent drive mechanisms for the pairs of water application device and reamer.

Some of the main benefits achieved by one or more of the disclosed embodiments include:

(1) Improved heat transfer by virtue of the heat exchanger's aluminum material and associated high heat conductivity, which reduces the ice machine size and yielding higher output for a given size of ice machine.

(2) Improved heat transfer by virtue of enhanced heat transfer surfaces in the heat exchanger, which contributes to reducing ice machine size and yielding higher output for a given size of ice machine.

(3) Improved heat transfer by virtue of thinner non-corrosive shell or liner, reducing ice machine unit size or yielding higher output for a given size.

(4) Thinner wall construction for the heat exchanger and therefore reduced material costs.

(5) Reducing the impact of pressurized portions rupturing thereby eliminating the requirement to construct the heat exchanger to pressure vessel manufacturing codes and eliminating the associated inspections.

(6) Lower energy cost, resulting from a lower temperature differential between the forming ice and the refrigerant.

(7) Reduced capital cost for the accompanying refrigeration system by virtue of the lower temperature differential and the physics of refrigeration.

The term "coating" as used herein is intended to encompass both the application of protective coatings, such as industrial Teflon, to the heat exchanger surface, as well as plating, e.g., electroplating, wherein a metal such as chromium or chromium alloy is bonded to the surface of the heat exchanger to form a protective, durable surface.

The term "water" as used herein is intended to encompass both fresh water and salt water, as well as any aqueous solution that is desirable to freeze.

Various modifications to the illustrated embodiments may be made without departure from the spirit and scope of the invention. For example, the design of the fluid passages within the heat exchanger can vary widely, for example they could all communicate with each other. This true scope and spirit is to be arrived at by reference to the appended claims, interpreted in light of the foregoing specification.

I claim:

1. A method of manufacturing a heat exchanger for an ice machine, comprising the steps of: obtaining an extrusion of a metal such as an aluminum alloy in the form of a substantially flat panel comprising first and second opposite walls, first and second edges, and connecting structures extending between and separating the first and second walls defining refrigeration passages positioned between the first and second opposite walls, and bending the substantially fiat panel into a cylinder such that the first and second edges are brought into proximity, with the first wall forming the outer wall of the cylinder and the second wall forming the inner wall of the cylinder; further comprising the step of cutting back alternating ends of the connecting structures in the a region proximate to the edges to thereby create passages for flow of refrigerant from one passage to an adjacent passage.

2. The ice machine of claim 1, wherein the refrigeration passages further comprise a multitude of raised and recessed features increasing the surface area of the refrigeration passages thereby enhancing the heat transfer characteristics of the heat exchanger.

3. The method of claim 1, further comprising the step of fitting an end cap to at least one of the first and second edges.

4. The method of claim 1, further comprising the step of fitting an end cap to both the first and second edges.

5. The method of claim 1, further comprising the steps of:

manufacturing two or more of the heat exchangers using the method of claim 1, and abutting the two or more heat exchangers together in a longitudinal arrangement to thereby form a unitary heat exchanger.

6. The method of claim 1, further comprising the step of fitting a metal shell to one or both of the inner and outer walls of the cylinder.

7. The method of claim 1, further comprising the step of applying a coating to one or both of the inner and outer walls.

8. The method of claim 1, wherein the first and second edges are bent such that they are placed in proximity to each other and separated by a gap, and wherein a manifold for introduction of a refrigerant into the refrigeration passages is welded in the gap between the first and second edges to thereby complete the cylinder.

* * * * *